United States Patent [19]

Buxbom

[11] 3,991,532

[45] Nov. 16, 1976

[54] SIGN POST CONSTRUCTION

[75] Inventor: Seymour Buxbom, Riverside, Calif.

[73] Assignee: Desert Outdoor Advertising, Inc., Riverside, Calif.

[22] Filed: Apr. 12, 1974

[21] Appl. No.: 460,544

Related U.S. Application Data

[63] Continuation of Ser. No. 357,945, May 7, 1973, abandoned, which is a continuation of Ser. No. 178,034, Sept. 7, 1971, abandoned.

[52] U.S. Cl. ..... 52/297; 52/725; 52/727; 52/742; 52/743

[51] Int. Cl.[2] ..... E02D 27/42; E04C 3/34; E04G 21/00

[58] Field of Search ..... 52/297, 727, 724, 725, 52/309, 653, 296, 742, 743

[56] References Cited

UNITED STATES PATENTS

| | | | |
|---|---|---|---|
| 1,018,754 | 2/1912 | Ford | 52/727 |
| 1,688,957 | 10/1928 | Bitney | 52/653 |
| 3,013,584 | 12/1961 | Reed et al. | 52/727 X |
| 3,429,758 | 2/1969 | Young | 52/725 |
| 3,471,980 | 10/1969 | Archer et al. | 52/115 |
| 3,501,920 | 3/1970 | Uchiyama | 52/223 R X |

*Primary Examiner*—Ernest R. Purser
*Assistant Examiner*—William Randolph
*Attorney, Agent, or Firm*—Brown & Martin

[57] ABSTRACT

A sign post for supporting a sign having a length of pipe of composite resin-bonded glass fibers material that is set in the ground with reinforcing therein and filled with cement and a second pipe of the material with reinforcing therein set in the upper end of said first pipe with cement therein, and with lengths of the pipe and reinforcing so disposed to the height desired for supporting a sign.

3 Claims, 5 Drawing Figures

SIGN POST CONSTRUCTION

This is a continuation of application Ser. No. 357,945, filed May 7, 1973, now abandoned, which in turn is a continuation of application Ser. No. 178,034, filed Sept. 7, 1971, now abandoned.

BACKGROUND OF THE INVENTION

There are many different methods of supporting large outdoor signs. These known methods use sign posts that are generally constructed of wood or steel. However in the use of signs adjacent freeways, tall buildings, and the like, and the requirement of placing signs a spaced distance from highways and freeways, it is necessary that signs be supported at great heights. This requires a sign post that is strong and rigid to support large signs at great heights from the ground. The foregoing has been further complicated by the use of lighted signs, and signs that have catwalks and the like that allow the workers to change the displays. All of this requires new and improved sign post constructions to support the large weight at great heights. Because of these requirements, wood sign posts have not been able to carry the weight at the height desired. Thus steel girders and the like have been used. The steel girder supports normally use large steel girders that are embedded into the ground and to which successive lengths of girders are secured to support the heavy sign at the height desired. However these steel girders, while having considerable strength, are expensive and require painting or the like to preserve their appearance and to prevent corrosion from the elements. While steel pipes have been used, the attachment of the steel pipes is difficult and the steel pipes are heavy, expensive and have internal and external corrosion problems.

Thus it is advantageous to have a new sign post construction that has a relatively light weight for the structure involved, is less expensive, does not have corrosion problems, and has a pleasing outer appearance that does not require servicing.

SUMMARY OF THE INVENTION

In an exemplary embodiment of the method and construction of this invention, a length of pipe that is preferably made of resin-bonded glass fibers composite construction, such as a composite structure of polyester resin and mortar, reinforced with continuous fiberglass filaments, is positioned vertically with one end in a foundation in the ground where it is cemented in place. Steel reinforcing is placed within the length of pipe, which pipe is then filled with cement. A second length of reinforcing is then placed with its lower end in the upper end of the first length of pipe and is projected into the cement. A second length of resin-bonded glass fibers pipe is then inserted with its lower end into the upper end of the first length of pipe and the second length of pipe is filled with cement. If the second length of pipe rises to the height desired, then horizontal stringers are secured to the second length of pipe to support the sign. If additional height is required, then a third length of pipe having a diameter smaller than the second length of pipe is inserted with reinforcing into the upper end of the second length of pipe in the same manner previously described relative to inserting the second length of pipe and reinforcing into the upper end of the first length of pipe. The third length of pipe is filled with cement and the sign board stringers are then secured to the third length of pipe. Successive lengths of resin-bonded glass fibers pipe with reinforcing can be used as desired to build up a post of any required reasonable height. Over 100 feet is practical.

The particular resin-bonded glass fibers pipe used has high strength and yet is lightweight and concrete adheres to its surface. The outer surface of the pipe has a pleasing appearance that may have any desired outer design surface and which surface does not corrode and is not required to be painted. Thus this method and construction provides a strong and yet relatively lightweight and inexpensive sign post construction that utilizes the properties of the concrete to support the sign and employs the fiberglass type pipe as a form for the concrete and reinforcing as well as providing a pleasing and non-corrosive outer surface and appearance to the entire composite structure.

It is therefore an object of this invention to provide a new and improved sign post construction and method of construction.

It is another object of this invention to provide a new and improved sign post construction and method of construction that employs a resin-bonded glass fibers pipe having high strength and lightweight to form an enclosure for a concrete post with reinforcing that can be used in multiple lengths to support a sign.

Other objects and many advantages of this invention will become more apparent upon a reading of the following detailed description and an examination of the drawings wherein like reference numerals designate like parts throughout and in which.

Figure 1:
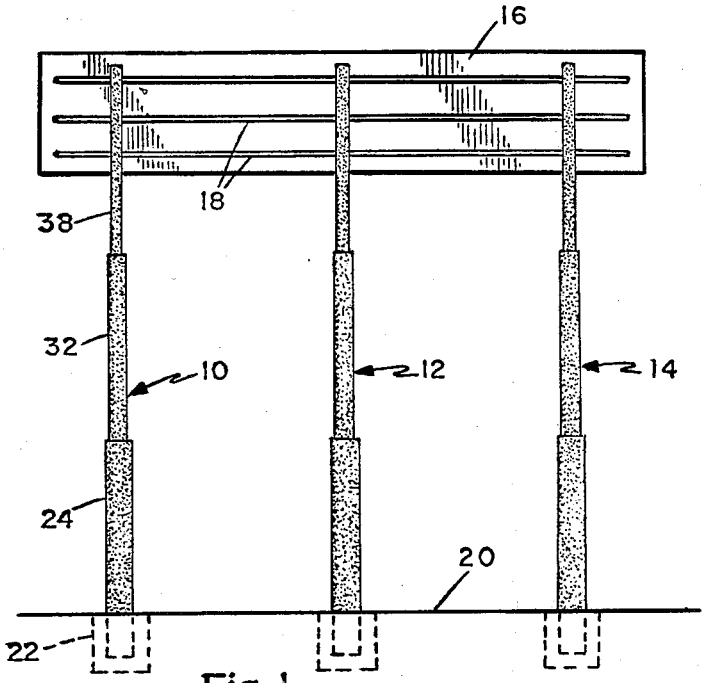
FIG. 1 is a rear view of a sign post construction using several posts of this invention.

Referring now to the drawings, FIG. 1 illustrates a sign post construction for supporting a large sign 16. This sign has posts 10, 12 and 14 that are set in the ground 20, and have interconnecting stringers 18 that are of steel that are secured to the upper ends of the respective posts. The sign construction is then attached to the steel stringers 18 in the known manner. While signs may be supported by a single post, two posts, three posts or however many posts are necessary, the sign post construction is normally consistent for each of the sign posts.

Figure 2:
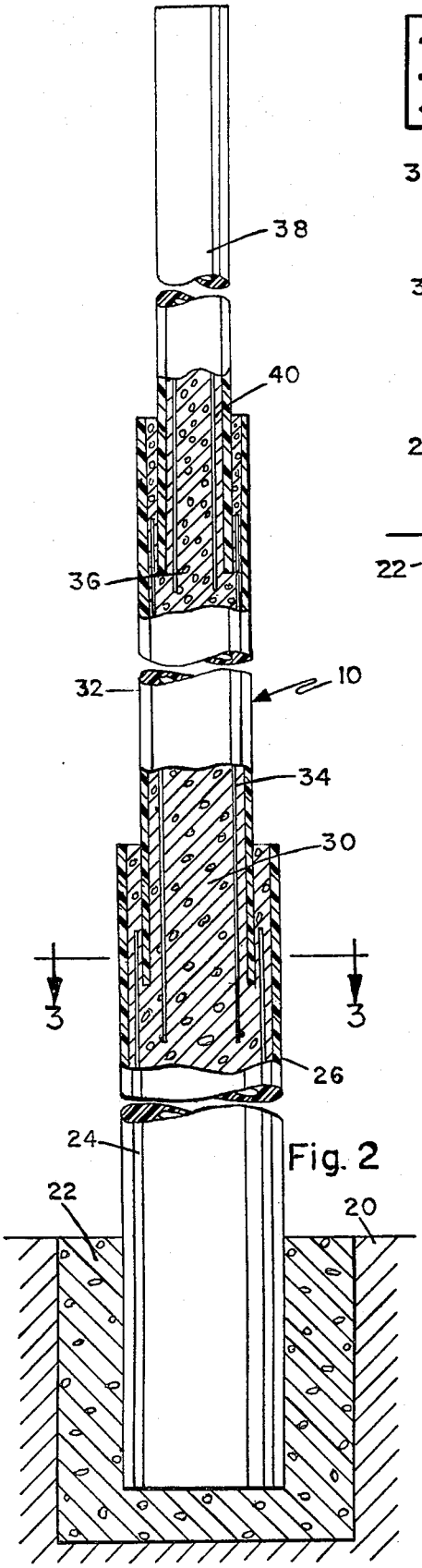
FIG. 2 is an enlarged view of a signal post of this invention, with portions cut away.
Figure 4:
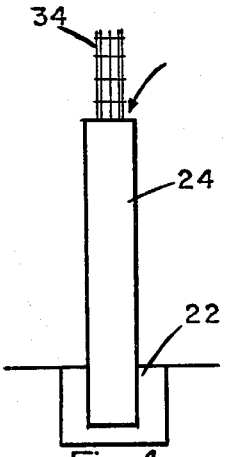
FIG. 4 is a diagrammatic view showing the initial erection of a post section of this invention.
Figure 5:
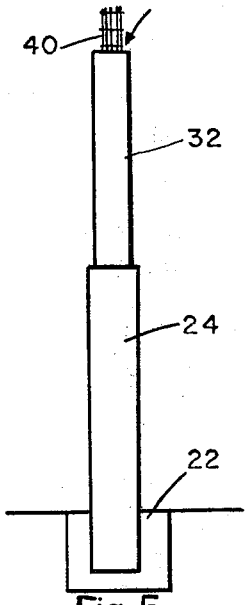
FIG. 5 is a diagrammatic view showing the addition of a further post section in the construction of this invention.
Figure 3:
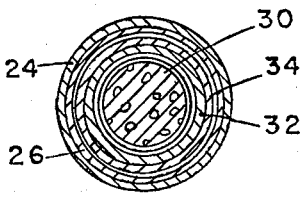
FIG. 3 is a sectional view taken on line 3—3 of FIG. 2.

The respective sign post 10 being used as an example of an embodiment of the structure of this invention, is generally illustrated in cross section with parts broken away in FIG. 2. This sign post 10 comprises a pipe 24 that is set in concrete 22 in the ground 20. The steel reinforcing 26 is positioned in the pipe. This steel reinforcing may comprise a steel rebar cage, having vertical rebars and horizontal wire connectors. The reinforcing can take other forms such as wire cage reinforcing.

The particular pipe employed is preferably a resin-bonded glass fibers pipe having high strength and light weight that is non-corrosive and that has a pleasing outer appearance. A particular type of pipe that is preferred, as a part of this invention, is a composite structure of resin-bonded glass fibers polyester resin and sand in the form of a polyester resin mortar reinforced with continuous resin-bonded glass fibers elements. A particular manufacturer of this type of pipe is the United Technology Center in Riverside, California that makes and sells this pipe under the trademark "Techite".

After the length of pipe 24 and reinforcing 26 are placed in position, then the pipe is filled with cement and a second reinforcing section 34 is inserted into the upper end of pipe 24 and into the cement 30. A second length of pipe 32 having a smaller diameter than pipe 24, is inserted into the upper end of the pipe 24 and into the cement 30. When in position, a second course of cement 36 is inserted into pipe 32. Then a third length of reinforcing 40 is inserted into the pipe 32 with a third length of pipe 38, having a smaller diameter than the pipe 32, inserted into the upper end of the length of pipe 32 and filled with cement. It may be understood that any number of sections of this pipe may be used in successive sections, to achieve the desired height and strength required to support a given sign. The reduced diameter of the successive sections provides the required strength at the given height and reduces the weight of the upper portion. The stringers 18 may be secured to the upper end of the upper length of pipe by bolts, clasps or in any other suitable manner.

It will be noted that the lengths of reinforcing are overlapped and that the pipes and reinforcing are also overlapped. This provides optimum strength of construction in using the strength of the fiberglass pipe and the reinforcing.

Having described my invention, I now claim.

1. The method of making a sign post construction comprising, supporting a length of fiberglass type pipe vertically in the ground, placing reinforcing in said pipe, filling said pipe with cement, forcing the lower end of a second steel reinforcing into the upper end of said length of pipe and into said cement, forcing the lower end of a second length of pipe over said reinforcing and into said cement through the upper end of said length of pipe wherein the lower end of said second reinforcing is disposed below the upper edge of said first reinforcing and said lower end of said second pipe is below the upper edge of said first reinforcing.

and securing a sign to the upper end of said second length of pipe.

2. The method claimed in claim 1 being characterized by, said first and second lengths of pipe comprising pipe made from a composite structure of fiberglass, polyester resin and sand.

3. A sign post construction comprising, a length of fiberglass type pipe set vertically in a foundation in the ground and having steel reinforcing positioned therein and said pipe being filled with concrete, a second length of fiberglass type pipe having a smaller diameter than said first length of pipe and having its lower end positioned in the upper end of said first length of pipe and in said concrete, said second length of pipe having reinforcing positioned therein and being filled with concrete, means secured to the upper end of said second length of pipe for supporting a sign, said steel reinforcing comprising steel rods arranged in a rebar cage and being vertically disposed in said first and second lengths of pipe, and said rebar cage of said first length of pipe extending above the lower edge of said second length of pipe and said rebar cage of said second length of pipe extending below the lower edge of said second length of pipe.

* * * * *